United States Patent [19]

Dorman et al.

[11] Patent Number: 4,541,681

[45] Date of Patent: Sep. 17, 1985

[54] ELECTRICAL CONNECTION OF WIRE CONDUCTOR(S) TO A TERMINAL PIN IN AN ELECTRODE ASSEMBLY OF A PACING LEAD

[75] Inventors: Frederick S. Dorman, Boca Raton; Charles A. Peers-Trevarton, Coral Springs, both of Fla.

[73] Assignee: Cordis Corporation, Miami, Fla.

[21] Appl. No.: 491,401

[22] Filed: May 4, 1983

[51] Int. Cl.[4] ..... H01R 11/18

[52] U.S. Cl. ..... 339/100; 339/67

[58] Field of Search ..... 339/100, 67, 69, 70, 339/71, 72, 73

[56] References Cited

U.S. PATENT DOCUMENTS

| | | | |
|---|---|---|---|
| 1,584,533 | 5/1926 | Hands . | |
| 1,779,804 | 10/1930 | Dubilier . | |
| 2,104,888 | 1/1938 | Spahr | 240/10.61 |
| 2,353,222 | 7/1944 | Stoffel et al. | 339/100 |
| 2,759,166 | 8/1956 | Mallina | 339/276 |
| 2,792,560 | 5/1957 | Bollmeier | 339/67 |
| 3,243,755 | 3/1966 | Johnston | 339/17 |
| 3,262,085 | 7/1966 | Slick | 339/100 |
| 3,649,743 | 3/1972 | O'Loughlin | 174/84 |
| 4,000,745 | 1/1977 | Goldberg | 339/67 |
| 4,091,233 | 5/1978 | Berman | 339/100 |
| 4,316,646 | 2/1982 | Siebens | 339/100 |

*Primary Examiner*—Gil Weidenfeld
*Assistant Examiner*—Thomas M. Kline
*Attorney, Agent, or Firm*—Henry W. Collins; Thomas R. Vigil

[57] ABSTRACT

The electrode assembly (10) is adapted to be mounted at the distal end of a pacing lead (19) and comprises a mushroom shaped tip electrode (12, 90) having a reduced in diameter terminal pin (22, 42, 62, 92) extending rearwardly therefrom. A sleeve (34) of insulating material is positioned about said terminal pin (22, 42, 62, 92) and a coiled single or multiple wire conductor bared end portion (18, 44, 64, 96) of the pacing lead (19) is received on the terminal pin (22, 42, 62, 92) within the sleeve (34). The pin (22, 42, 62, 92) has a spiral, thread-like formation (48; 98,100) or ramp formation (66) thereon onto which the bared wire conductor end portion (18, 44, 64, 96) is threaded to form a secure and good mechanical and electrical connection (35, 60, 80, 110) between the terminal pin (22, 42, 62, 92) and the bared wire conductor end portion (18, 44, 64, 96).

13 Claims, 8 Drawing Figures

ELECTRICAL CONNECTION OF WIRE CONDUCTOR(S) TO A TERMINAL PIN IN AN ELECTRODE ASSEMBLY OF A PACING LEAD

BACKGROUND OF THE INVENTION

1. Field of the Invention

The present invention relates to an electrical connection, of one or more conductive coils to a metal terminal pin extending rearwardly from a tip electrode in an electrode assembly at the distal end of a pacing lead which is used to apply electrical pulses to the muscles of a heart.

2. Description of the Prior Art

Heretofore various electrical connections including a wound conductor on a bar or pin in an electrical connection have been proposed. Examples of such previously proposed electrical connections are disclosed in the following U.S. patents:

| U.S. PAT. NO. | PATENTEE |
|---|---|
| 1,584,533 | Hands |
| 1,779,804 | Dubilier |
| 2,104,888 | Sparh |
| 2,759,166 | Mallina |
| 2,792,560 | Bollmeier |
| 3,243,755 | Johnston |
| 3,649,743 | O'Loughlin |

The Hands U.S. Pat. No. 1,584,533 discloses a terminal connection for attaching resistor heating elements to a furnace terminal. This terminal connection is formed by a helically wound portion at the end of a heating wire which portion is received about a threaded shaft of a bolt. A nut is then received over the helically wound portion on the bolt shaft.

The Dubilier U.S. Pat. No. 1,779,804 discloses a lamp socket including a coiled spring which receives the neck of a lamp.

The Sparh U.S. Pat. No. 2,104,888 discloses a device for connecting a flashlight bulb to a battery and includes a wire into one coiled end of which a flashlight bulb is screwed.

The Mallina U.S. Pat. No. 2,792,560 discloses a wire connector for mechanically fastening the ends of solid or stranded electrical wires to rivets, bolts other rods or wires, etc. The connector includes a center core portion or tube through which a solid or stranded electrical wire is inserted to place same on a serrated surface and held thereon by means of a steel spring threaded thereover.

The Johnston U.S. Pat. No. 3,243,755 discloses an electrical connector utilizing a pair of conical springs of similar size and arrangement, wherein one of the springs acts as a male member and the other as a female member and upon mating of the pair, connection is effected by contact of turns of the springs.

The O'Loughlin U.S. Pat. No. 3,649,743 discloses a wrapped wire connection comprising an elongate post having turns of a wire coductor Wrapped therearound with a deformable sleeve received over the wire turns.

In the present connection of an electrode assembly at the distal end of a pacing lead three components are needed. One is the bared coiled end of the single or multiple wire (filar) conductor of the lead. Another is a terminal pin or shank extending rearwardly from a mushroom shaped tip of a tip electrode. The third component is a sleeve or collar received over the bared coiled end on the pin or shank. The sleeve or collar is staked or crimped to secure the coil to the pin or shank.

As will be described in greater detail hereinafter, the electrical connection of the present invention differs from the wire connections disclosed in the patents referred to above and from the present staking of a sleeve received over a coil on a pin in an electrode assembly of a pacing lead by providing for the attachment of a coiled bare end of a single filar conductor or a multifilar conductor at the distal or proximal end of a pacing lead onto a terminal pin extending rearwardly from a distal tip electrode or forwardly from a proximal terminal electrode primarily by threading of the filar(s) onto a spiral or thread formation on the pin of the distal or proximal electrode.

SUMMARY OF THE INVENTION

According to the invention there is provided an electrical connection of an electrode assembly to an end of a pacing lead, said electrode assembly comprising an electrode having a terminal pin, said lead comprising at least two coiled wire conductors with bared end portions thereof being coiled in a spiral formation with a predetermined pitch and a predetermined axial spacing between adjacent groups of turns of coiled conductors and being received on said terminal pin and said pin having a spiral, thread-like formation including a spiral groove and a spiral ridge thereon with a pitch equal to said predetermined pitch and a spacing between axially spaced portions of said spiral groove equal to said predetermined spacing and onto which said bared wire conductor end portions are threaded to form a secure and good mechanical electrical connection between said terminal pin and said bared wire conductor end portions.

Further according to the invention there is provided an electrode assembly adapted to be mounted at the distal end of a pacing lead, said electrode assembly comprising a mushroom shaped tip electrode having a terminal pin with a diameter less than the diameter of the tip and extending rearwardly therefrom, a sleeve of insulating material positioned around said terminal pin and at least two coiled wire conductor bared end portions of the pacing lead being coiled in a spiral formation with a predetermined pitch and a predetermined axial spacing between adjacent groups of turns of wire conductors and being received on said terminal pin within said sleeve, said pin having a spiral, thread-like formation including a spiral groove and a spiral ridge thereon with a pitch equal to said predetermined pitch and a spacing between axially spaced portions of said spiral groove equal to said predetermined spacing and onto which said bared wire conductor end portions are threaded to form a secure and good mechanical and electrical connection between said terminal pin and said bared wire conductor end portions.

DESCRIPTION OF THE PREFERRED EMBODIMENTS

Figure 1:
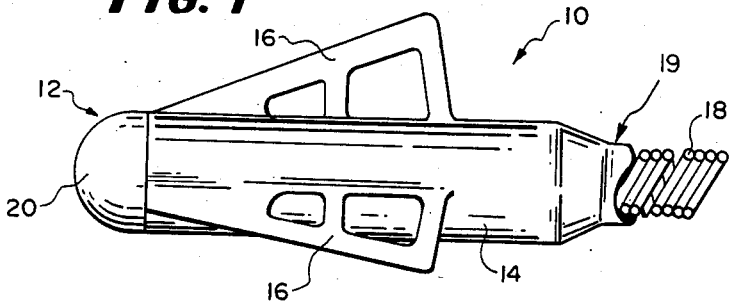
FIG. 1 is a side elevational view of an electrode assembly which is adapted to be mounted at the distal end of a pacing lead and which includes a tip electrode.

Referring now to FIG. 1 in greater detail there is illustrated therein an electrode assembly which is generally identified by reference numeral 10.

The electrode assembly 10 includes a tip electrode 12 at the distal end thereof and a sleeve 14 made of insulating material. In the embodiment shown in FIG. 1, the sleeve 14 is of the type which is provided with fins 16 and bared coiled conductive wires 18 of a pacing lead 19 are received within the sleeve 14.

Figure 2:
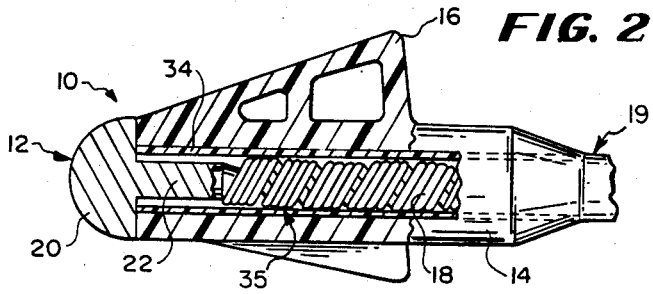
FIG. 2 is a partial axial sectional view of the electrode assembly shown in FIG. 1 and shows a tip electrode, a terminal pin extending rearwardly therefrom and a multifilar coil.

As shown in FIG. 2, the tip electrode 12 has a mushroom shaped tip 20 and a terminal pin 22 integral therewith and extending rearwardly from the tip 20. The terminal pin 22 is constructed according to the teachings of the present invention and is sized and configured to receive the coils of a single wire or filar coil (see FIGS. 3 and 4) or coils of a multiwire or multifilar coil 18 therearound (see FIGS. 5–8).

As shown, a sheath 34 of pacing lead 19 extends within the sleeve 14 and around the coil 18 which is wound or screwed onto the terminal pin 22 to form an electrical connection or termination 35.

Figure 3:
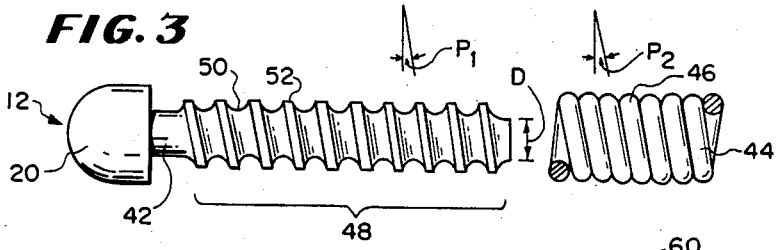
FIG. 3 is a side elevational view of one embodiment of an integral tip electrode and terminal pin particularly adapted for use with a single filar coil shown adjacent thereto.

Referring now to FIG. 3 there is illustrated therein an embodiment of the tip electrode 12 which has a terminal pin 42 adapted to receive a single filar coil 44 of conductive wire. The single filar coil 44 is preformed with a predetermined internal diameter and a predetermined distance between each turn 46 of the coil 44. In this embodiment, the terminal pin 42 is formed with thread like formation 48 including a spiral channel 50 around the pin 42 defined between each convolution of a spiral thread 52 extending outwardly from and around pin 42 at a pitch equal to that of the spiral channel 50. Each convolution of the spiral thread 52 is spaced a predetermined distance from the next convolution to allow convolutions of the channel 50 to receive turns 46 of the coil 44 therein.

The channel 50 has a root diameter D which can be the same as or slightly greater than the inner diameter of the coil 44 with the pitch $P_1$ of the machined helical thread 52 equal to the pitch $P_2$ of the coil 44. This formation 48 provides a friction fit thereby to provide for a strong mechanical retention and better electrical connection 60 between the pin 42 and coil 44.

As an alternative to an increased root diameter D of the channel 50, the pitch $P_1$ of the machined helical thread 52 can be slightly greater than the pitch $P_2$ of the coil 44, with the pitch $P_1$ being selected to leave a thin web of metal on each side of the channel 50.

Figure 4:
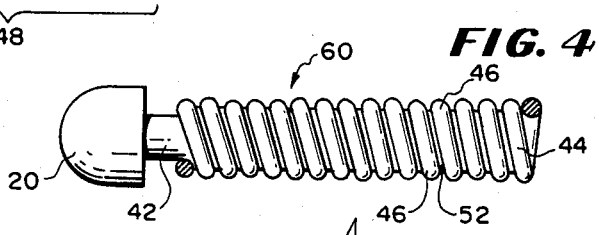
FIG. 4 is a side elevational view of the tip electrode and terminal pin shown in FIG. 3 with the single filar coil wire wound or screwed thereon.

Referring now to FIG. 4 there is illustrated therein the terminal pin 42 of FIG. 3 with the coil 44 received on the pin 42 and in the channel 50 therein. As shown, each convolution of the thread 52 fits snugly between two turns 46 of the coil 44. In making the connection 60, the coil 44 is attached to pin 42 by screwing the coil 44 onto the pin 42 as one would screw a nut onto a bolt. After the attachment of the coil 44 to the pin 42, the terminal pin 42 can be coated with a conductive adhesive thereby to improve the mechanical joint between pin 42 and coil 44 with no deleterious effect on the resulting electrical connection 60 formed thereby.

Figure 5:
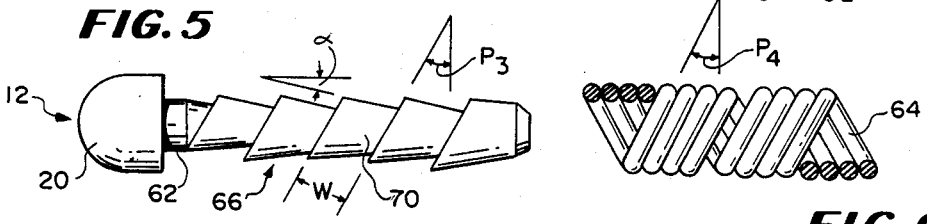
FIG. 5 is a side elevational view of another embodiment of a tip electrode and terminal pin particularly for use with the multifilar coil shown in FIG. 1 and shows a terminal pin with a helical spiral ramp about which turns of several filars are wound with the multifilar coil positioned adjacent thereto.

Referring now to FIG. 5 there is illustrated therein another embodiment of the tip electrode 12. Here a specially configured terminal pin 62 constructed to receive a multifilar coil 64 thereon is integral with and extends rearwardly from the tip 20.

This terminal pin 62 is provided with a spiral ramp formation 66 including a helical spiral ramp 70 having a pitch $P_3$ equal to the pitch $P_4$ of the coil 64 to be received therearound. Further the width W of the ramp 70 is equal to the width of one turn 74 of the multifilar coil 64 so that each composite turn of the coil 64 fits snugly on each convolution of the ramp 70. Here, the root diameter of each convolution of the ramp 70 varies between the inner diameter of each turn of the multifilar coil 64 and a greater diameter, i.e., it is inclined at an angle $\alpha$ to the axis of the pin 62 as shown to provide an interference fit between the coil 64 and ramp 70 as the coil 64 is screwed thereon thereby to provide strong mechanical retention of and good electrical connection between the coil 64 and pin 62. Here also, the terminal pin 62 can be coated with a suitable adhesive to improve the mechanical joint between the multifilar coil 64 and the pin 62.

Figure 6:
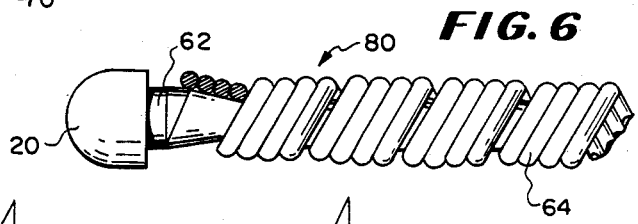
FIG. 6 is a side elevational view of the tip electrode and terminal pin shown in FIG. 5 with the multifilar coil wound or screwed thereon.

After the coil 64 is threaded onto the pin 62, a good electrical and mechanical connection 80 is formed as shown in FIG. 6.

Figure 7:
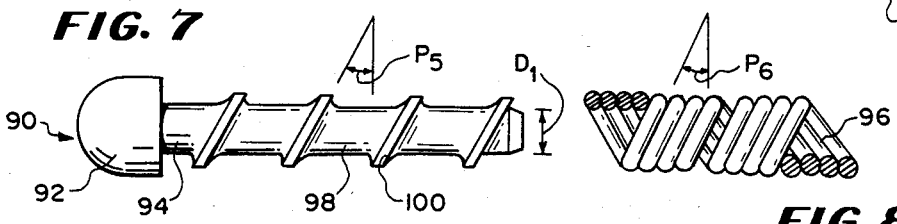
FIG. 7 is a side elevational view of still another embodiment of a tip electrode and terminal pin also adapted for receiving a multifilar coil therearound with such a multifilar coil positioned adjacent thereto.

Another embodiment of a tip electrode 90 with a tip 92 and a terminal pin 94 adapted for use with a multifilar coil 96 is shown in FIG. 7. This tip electrode 90 is very similar to the tip electrode 12 shown in FIG. 3. A helical channel 98 is formed about the pin 94 between convolutions of a helical thread 100 similar to the spiral channel 50 shown in FIG. 3.

However, in this embodiment, the width of the channel 98 is greater than that of the channel 50 on the terminal pin 42 to facilitate threading thereon of a multiple filar coil 96. The helical thread formation 100 separates the turns of the multifilar coil 96 as they are screwed onto the pin 94. Here, as previously, the pitch $P_5$ of the helical thread 100 is equal to that of the spiral channel 98. Further, the root diameter $D_1$ of the channel 98 is slightly greater than the inner diameter of the multifilar coil 96 to facilitate mechanical retention and better electrical connection between the multifilar coil 96 and the pin 94.

Again, as an alternative to the increased root diameter D of the channel 98, the pitch of the machined helical thread 100 can be slightly greater than the pitch $P_6$ of the coil 96, with the pitch being selected to leave a thin web of metal on each side of the channel 98.

Figure 8:
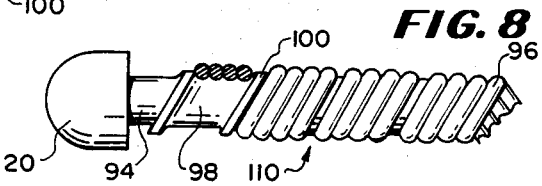
FIG. 8 is a side elevational view of the tip electrode and terminal pin shown in FIG. 7 with the multifilar coil wound or screwed thereon.

Referring now to FIG. 8, there is illustrated therein the terminal pin 94 with the coil 96 received on or threaded onto pin 94 and in the channel 98. As shown, each convolution of the thread 100 fits snugly between two turns of the coil 96. In making the connection, once again, the coil 96 is attached to the pin 94 by screwing the coil 96 onto the pin 94 as one would screw a nut onto a bolt.

After attachment of the coil 96 to the pin 94, the terminal pin 94 can be coated with a adhesive thereby to improve and enhance the mechanical joint between pin 94 and coil 96 with no deleterious effect on the resulting electrical connection 110 formed thereby.

It is to be noted from the drawings, and in particular from FIGS. 3, 5, and 7 that the pitch of the channel 50, 98 within which the single or multifilar coils 18, 44, 64, 96 are received is dependent upon the number of filars forming the particular coil 18, 44, 64, 96 which is to be received within the channel 50 or 98 or on ramp 70. It can be seen from FIG. 3 that the pitch of the single filar coil 44 is toward the terminal pin 42 while the pitch of the multifilar coil 64 or 96 shown in FIGS. 5 and 7 is away from the terminal pin. Obviously the pitch can be in either spiral direction.

The electrode assembly 10 of the present invention and particularly the electrical connection 35, 60, 80 or 110 formed between termianl pin 22, 42, 62 or 94 and coil 18, 44, 64 or 96 provide advantages over previous coil/pin terminations or connections. In this respect, present terminations require three components, a pin, a coil end over the pin, and a collar over the coil and pin fixed together by crimping or staking the collar. Obviously, the more components, the greater the size of the termination.

The construction and configuration of the terminal pin of the present invention eliminates the need of one of the prior art components, i.e., namely the collar or sleeve, and provides for a smaller size termination or connection of the coil on the pin. Also the screw thread connection inhibits pulling part of the pin and coil.

Further, by making an interference fit either by forming a terminal pin with a root diameter slightly larger than the inner diameter of the coil or by making the pitch of the thread and channel formation on the terminal pin greater than the pitch of the coil, a high resistance to torque and pull off is developed.

Still further, tooling, parts, and assembly labor costs are reduced by the simplification of the construction and method for forming same. In this respect, no special tools are required for assembly, i.e., staking or crimping, and the technique only requires the coil be screwed onto the terminal pin or shank, and, if desired, coated with an adhesive.

The method for attaching a coiled bare wire end portion 18, 44, 64 or 96 of a pacing lead 19 to a terminal pin or shank 22, 42, 62 or 94 extending rearwardly from a mushroom shaped or bullet shaped electrode tip 20 by means of screwing the coiled bare wire end portion 18, 44, 64 or 96 onto a helical or spiral formation 48; 66; 98, 100 on the terminal pin or shank 22, 42, 62 or 94 provides an attachment or electrical connection 35, 60, 80 or 110 which is simpler and mechanically and electrically better than the previous attachment of a conductive coil to a metal termination, e.g., pin, using a smooth pin or shank with a coil thereover and a collar or sleeve received over the coil and pin and drimped or staked thereon.

Also, depending upon the construction of the coil, the spiral or helical thread like formation on the pin can be configured in different ways. For example, for a single filar coil, where a spiral groove or channel of semi-circular cross section is machined on the terminal pin, the pitch of the spiral can be made equal to the pitch of the coil or can be made greater than the pitch of the coil.

On the other hand, the root diameter D of the groove or channel can be slightly greater than the root diameter of the single filar or multifilar coil to provide an interference fit.

In the embodiment shown in FIGS. 5 and 6, the pin or shank 62 is provided with a helical ramp 70 machined on it. The width W of the ramp is equal to the width of the filars so that the filars sit side by side on the ramp 70. The pitch of the helical ramp 70 is equal to the pitch of the filars. However, as described above, the ramp 70 is inclined so as to have a varying diameter starting with a diameter equal to or slightly less than the inner diameter of the coil 64 and extending to a diameter greater than the inner diameter of the coil 64.

Then, in the embodiment shown in FIGS. 7 and 8, the spiral channel 98 has a flat bottom and is machined onto the pin or shank 94. The width of the channel 98 is equal to the width of the filars in each turn of the coil 96. The pitch of the helical thread 100 is then selected to leave a thin web of metal on each side of the channel 98.

It is to be understood that the electrical connection of the present invention has a number of advantages some of which have been described above and others of which are inherent in the invention. Also, modifications can be made to the invention without departing from the teachings of the invention. For example, the electrical connection can be used in a coil termination at the proximal end of a pacing lead oetween a terminal such as a terminal pin and one or more bare end coiled filars. Accordingly, the scope of the invention is only to be limited as necessitated by the accompanying claims.

I Claim:

1. An electrical connection of an electrode assembly to an end of a pacing lead, said electrode assembly comprising an electrode having a terminal pin, said lead comprising at least two coiled wire conductors with bared end portions thereof being coiled in a spiral formation with a predetermined pitch and a predetermined axial spacing between adjacent groups of turns of coiled conductors and being received on said terminal pin and said pin having a spiral, thread-like formation including a spiral groove and a spiral ridge thereon with a pitch equal to said predetermined pitch and a spacing between axially spaced portions of said spiral groove equal to said predetermined spacing and onto which said bared wire conductor end portions are threaded to form a secure and good mechanical electical connection between said terminal pin and said bared wire conductor end portions.

2. The electrical connection of claim 1 wherein adjacent convolutions of said spiral ridge are formed with a predetermined distance therebetween for receiving said at least two turns of bared wire coil end portions of said at least two coiled wire conductors therebetween.

3. The electrical connection of claim 1 wherein the pitch of the spiral groove and spiral ridge is determined by the number and pitch of the coiled wires to be received therearound.

4. The electrical connection of claim 1 wherein said spiral groove is sized to receive a group of coiled turns of a predetermined number of wire conductors therein.

5. The electical connection of claim 1 wherein the turns of said at least two coiled conductors have an inner diameter and the root diameter of said spiral groove along a line having the angle of said pitch is greater than the inner diameter of said at least two coiled conductors.

6. The electrical connection of claim 1 wherein said spiral groove is in the form of an inclined ramp inclined relative to the axis of said pin with the width of the ramp being sized to receive a predetermined number of wire conductors thereon.

7. The electircal connection of claim 6 wherein the turns of said at least two coiled wire conductors have an inner diameter and said ramp has a ramp diameter, along a line having the angle of said predetermined pitch, which varies from a diameter equal to or less than the inner diameter of said turns of said coiled wire conductors to a diameter greater than the inner diameter of said turns of said coiled wire conductors.

8. The electrical connection of claim 1 wherein a conductive adhesive is applied to the terminal pin after threading said coil thereon.

9. The electrical connection of claim 1 wherein each convolution of said spiral ridge with said spiral goove therebetween serves to separate adjacent grooves or turns of said coiled wire conductors.

10. The electrical connection of claim 1 wherein said electrode assembly is a distal electrode assembly mounted to the distal end of said pacing lead.

11. The electrical connection of claim 10 wherein said distal electrode assembly comprises a mushroom shaped tip electrode having said terminal pin extending rearwardly therefrom, said pin has a reduced diameter less than the diameter of said tip electrode, said pacing lead has a sleeve of insulating material positioned about said at least two coiled wire conductors, and said bared end portions of said wire conductors of said pacing lead are received on said terminal pin within an end of said sleeve.

12. The electrical connection of claim 11 wherein said spiral groove is in the form of a helical ramp on said pin which is inclined outwardly from the axis of said pin in a direction toward said mushroom shaped tip of said tip electrode.

13. An electrode assembly adapted to be mounted at the distal end of a pacing lead, said electrode assembly comprising a mushroom shaped tip electrode having a terminal pin with a diameter less than the diameter of the tip and extending rearwardly therefrom, a sleeve of insulating material positioned around said terminal pin and at least two coiled wire conductor bared end portions of the pacing lead being coiled in a spiral formation with a predetermined pitch and a predetermined axial spacing between adjacent groups of turns of wire conductors and being received on said terminal pin within said sleeve, said pin having a spiral, thread-like formation including a spiral groove and a sprial ridge thereon with a pitch equal to said predetermined pitch and a spacing between axially spaced portions of said spiral groove equal to said predetermined spacing and onto which said bared wire conductor end portions are threaded to form a secure and good mechanical and electrical connection between said terminal pin and said bared wire conductor end portions.

* * * * *